US012011121B2

(12) United States Patent
Madden

(10) Patent No.: US 12,011,121 B2
(45) **Date of Patent: *Jun. 18, 2024**

(54) SINGLE FREE-STANDING PAPER TOWEL HOLDER AND TOWEL BAR

(71) Applicant: Laura Madden, Santa Rosa Beach, FL (US)

(72) Inventor: Laura Madden, Santa Rosa Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/304,882

(22) Filed: Apr. 21, 2023

(65) Prior Publication Data

US 2023/0255414 A1 Aug. 17, 2023

Related U.S. Application Data

(63) Continuation of application No. 17/231,762, filed on Apr. 15, 2021, now Pat. No. 11,672,384.

(60) Provisional application No. 63/010,395, filed on Apr. 15, 2020.

(51) Int. Cl.
*A47K 10/38* (2006.01)

(52) U.S. Cl.
CPC ..... *A47K 10/3836* (2013.01)

(58) Field of Classification Search
None
See application file for complete search history.

(56) References Cited

U.S. PATENT DOCUMENTS

| | | | | |
|---|---|---|---|---|
| 3,227,386 | A | 1/1966 | Pitcher | |
| 4,720,053 | A | 1/1988 | Vance | |
| 4,792,102 | A | 12/1988 | Olson | |
| 6,726,145 | B1 | 4/2004 | Kraus | |
| 6,988,691 | B1 | 1/2006 | Lai | |
| 7,278,604 | B1 | 10/2007 | Constantino | |
| 10,517,442 | B2 | 12/2019 | Taylor | |
| D895,318 | S | 9/2020 | Dratch | |
| 11,092,487 | B2 | 8/2021 | Withrow et al. | |
| 11,141,028 | B2 | 10/2021 | Kamenstein et al. | |
| 11,672,384 | B2 * | 6/2023 | Madden | A47K 10/3836 242/597.7 |
| 2004/0195429 | A1 | 10/2004 | Demers et al. | |
| 2007/0210206 | A1 | 9/2007 | Nip et al. | |
| 2008/0011782 | A1 | 1/2008 | Sidman | |
| 2012/0234963 | A1 | 9/2012 | Channel et al. | |
| 2017/0319019 | A1 | 11/2017 | Simmons | |

(Continued)

OTHER PUBLICATIONS

U.S. Appl. No. 17/231,762, filed Apr. 14, 2021, US 2021-0321833 A1, Allowed.

(Continued)

*Primary Examiner* — William A. Rivera

(74) *Attorney, Agent, or Firm* — Alston & Bird LLP

(57) ABSTRACT

Embodiments provide for a consolidated towel holder or rack. An example consolidated towel holder includes a base, a first support member extending upward from the base, a second support member extending upward from the base and configured for supporting a paper towel roll, a cap in slidable contact with the first support member via an extension member such that the cap gravitationally rests atop the paper towel roll, and a third support member extending perpendicularly from the first support member and configured for supporting a fabric towel or cleaning apparatus.

19 Claims, 20 Drawing Sheets

(56) References Cited

U.S. PATENT DOCUMENTS

| | | | |
|---|---|---|---|
| 2020/0170459 | A1 | 6/2020 | Green et al. |
| 2020/0268220 | A1 | 8/2020 | Hong |

OTHER PUBLICATIONS

"SimplyTear™ Paper Towel Holder," Oxo, (2 pages), (article, online), [Retrieved from the Internet Aug. 18, 2021] <https://www.oxo.com/categories/cleaning-organization/kitchen/oxo-good-grips-simplyteartm-paper-towel-holder.html>.

* cited by examiner

SINGLE FREE-STANDING PAPER TOWEL HOLDER AND TOWEL BAR

CROSS-REFERENCE TO RELATED APPLICATIONS

This application is a continuation of U.S. patent application Ser. No. 17/231,762, filed Apr. 15, 2021, which claims priority to U.S. Provisional Application Ser. No. 63/010,395, titled "SINGLE FREE-STANDING PAPER TOWEL HOLDER AND TOWEL BAR," filed Apr. 15, 2020, the contents of all of which are incorporated herein by reference in their entirety.

BACKGROUND

Households commonly use a variety of towels for cleaning, hygiene, and other purposes. One example is kitchen (typically cloth-based) towels, utilized for drying dishes, hands, or the like. These kitchen towels are typically designed for multiple uses thereof. Another example is paper towels, typically paper-based (or other recycled, recyclable, or compostable material) and designed for single uses or at least to be disposable after a minimal number of uses. Both of these exemplary (and other) types of towels may oftentimes be used together or used in an overlapping space (e.g., kitchen, bath, laundry rooms, or the like).

Conventionally separate racks or mounting systems for different types of towels have been provided and/or otherwise been commercially available. Frequently, though, kitchen sinks are either in an island or away from upper cabinets so locating multiple towel bars or mounting systems is difficult. This is also true for other spaces (e.g., baths, laundry) where space is limited. Currently, in order to have both or multiple types of towels present and easily accessible requires: (1) two separate free standing holders, which takes up a lot of counter space, (2) laying kitchen towels on counter tops which takes up counter space and might be unsanitary, or (3) hanging the kitchen towels on an appliance handle like the dishwasher or oven handle, or alternatively/additionally on cabinet hardware. Towels hung up in this latter situation frequently fall on the floor, drag the ground when the appliance door is opened or get caught in the cabinet door or drawer when it closes.

Accordingly, there exists a dire need for a consolidated towel rack or holder capable of supporting and making accessible multiple towels. The consolidated towel rack or holder is also preferably easy to use, without requiring disassembly or reconfiguration for utilization with different (or different types) of towels.

SUMMARY

Embodiments herein provide for a consolidated towel rack or holder. In example embodiments, a consolidated towel holder includes a base, a first support member extending upward from the base, a second support member extending upward from the base and configured for supporting a paper towel roll, and a cap in slidable contact with the first support member via an extension member such that the cap gravitationally rests atop the paper towel roll. In embodiments, the example consolidated towel holder further includes a third support member extending perpendicularly from the first support member and configured for supporting a fabric towel or cleaning apparatus.

Other systems, devices, methods, features and advantages of the subject matter described herein will be or will become apparent to one with skill in the art upon examination of the following figures and detailed description. It is intended that all such additional systems, methods, features and advantages be included within this description, be within the scope of the subject matter described herein, and be protected by the accompanying claims. In no way should the features of the example embodiments be construed as limiting the appended claims, absent express recitation of those features in the claims.

BRIEF DESCRIPTION OF THE DRAWINGS

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

DETAILED DESCRIPTION

Before the present subject matter is described in detail, it is to be understood that this disclosure is not limited to the particular embodiments described, as such may, of course, vary. It is also to be understood that the terminology used herein is for the purpose of describing particular embodiments only, and is not intended to be limiting, since the scope of the present disclosure will be limited only by the appended claims.

Embodiments of the present disclosure are directed to a consolidated towel rack or holder that overcomes the aforementioned drawbacks and more associated with conventional solutions. Embodiments herein provide for a single consolidated towel rack or holder having multiple support members configured for receiving and/or supporting a paper towel roll (e.g., or other similar product) as well as one or more additional kitchen or hand towels (e.g., or other household cleaning apparatus). In providing for a single consolidated towel rack or holder configured to support and/or receive multiple disparate paper towel rolls, kitchen or other towels, or other household cleaning apparatuses or products, embodiments herein eliminate wasted counter space, unsanitary storage of household products (e.g., by way of preventing a wet kitchen or other towel from sitting on a counter and growing bacteria, mold, fungus, or other undesirable agent), and enable easy transfer or portability of the supported products. Moreover, embodiments herein may be configured with a weighted cap extending outward from a central support member, where the weighted cap is gravitationally in contact with a top of a paper towel roll supported by the central support member. The weighted cap is configured such that it provides enough tension or force on the top of the paper towel roll to stabilize the paper towel roll while also allowing for free and easy rotation of the paper towel roll around the central support member.

Figure 1:
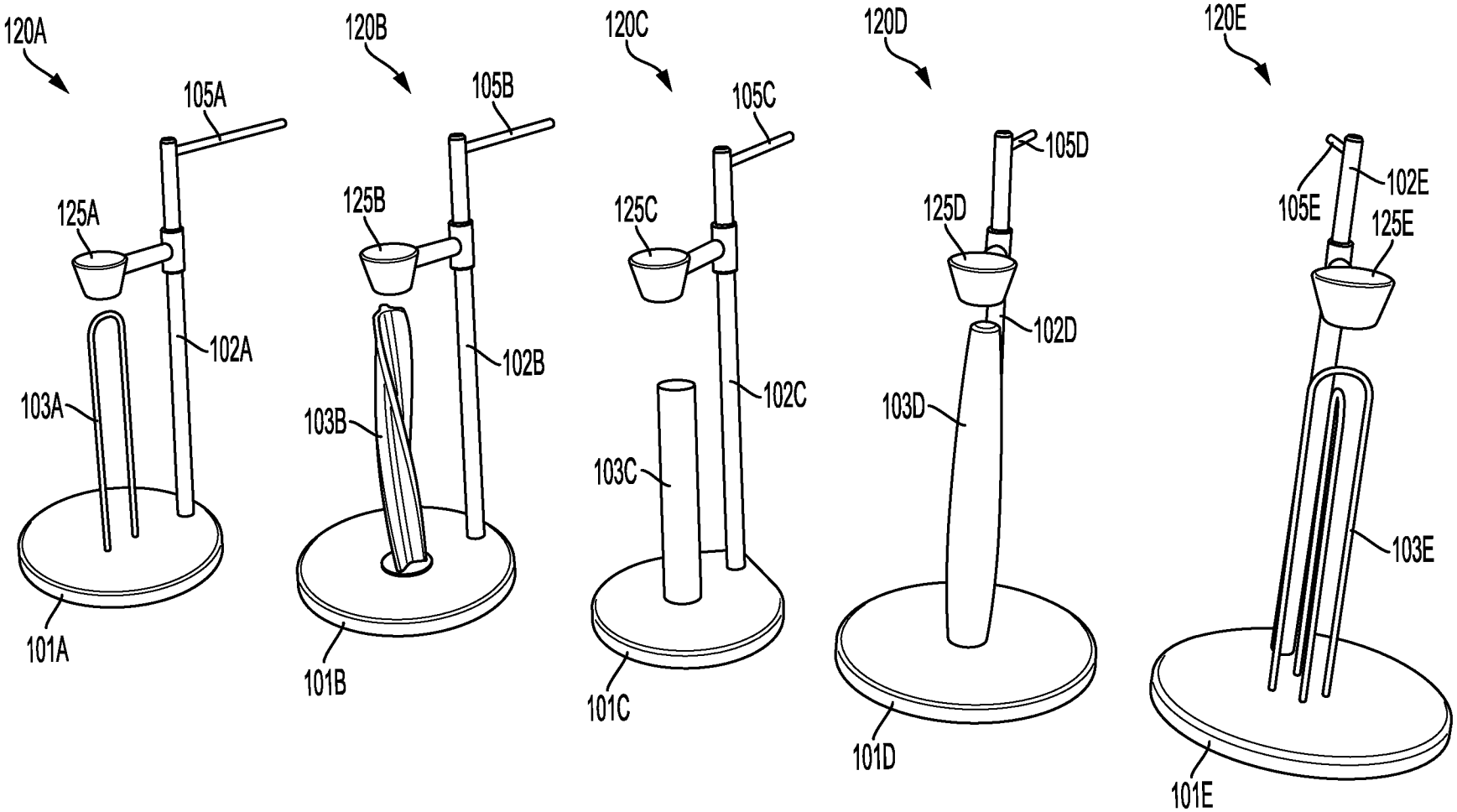
FIG. 1 illustrates several example consolidated towel racks or holders according to various embodiments of the present disclosure.
Figure 2:
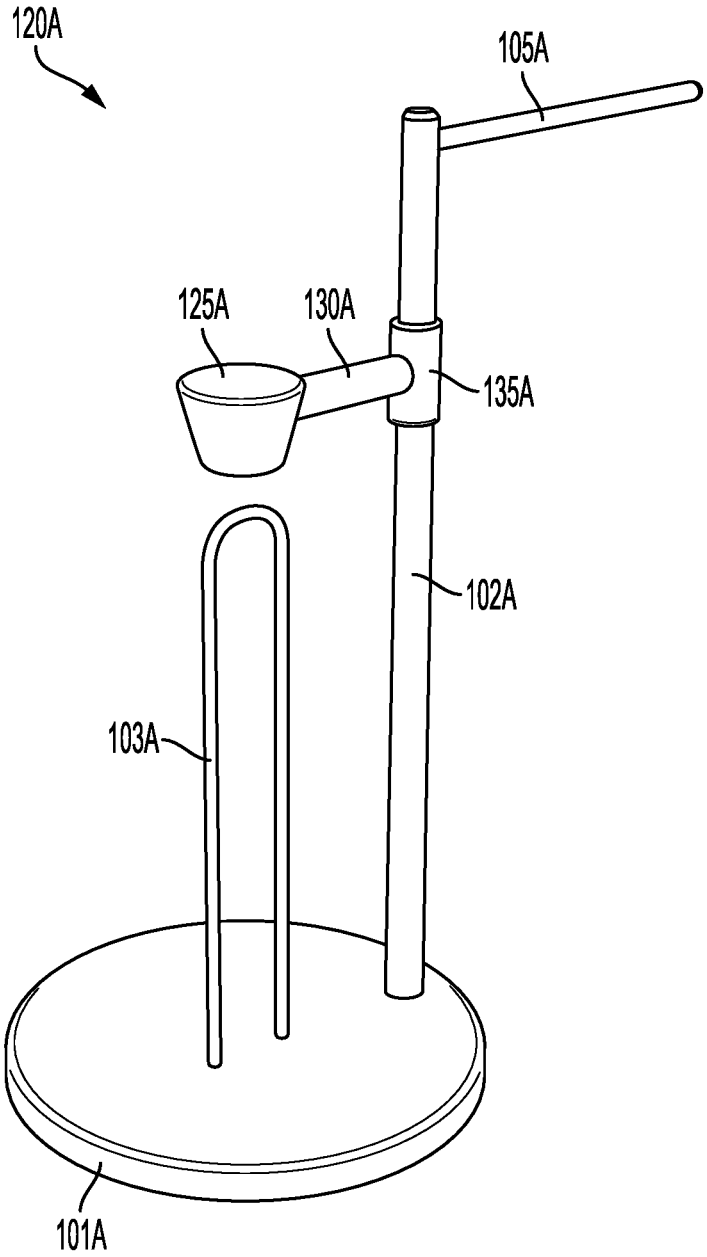
FIG. 2 illustrates an example consolidated towel rack or holder according to various embodiments of the present disclosure.

FIG. 2 illustrates an example consolidated towel rack or holder 120A according to various embodiments of the present disclosure. In FIG. 2, an example consolidated towel rack or holder 120A includes a base 101A, a first support member 102A, a second support member 103A, a weighted cap 125A, and a third support member 105A. The weighted cap 125A may be in contact with first support member 102A by way of a slide mechanism 135A. The weighted cap 125A may extend, via an extension member 130A, outwardly from first support member 102A. In various embodiments, the second support member 103A may be configured to receive and support a paper towel roll (not shown in FIG. 2). In at least the illustrated embodiment, the third support member 105A, in combination with the first support member 102A, may be configured to receive and support a (e.g., kitchen, hand, cloth, or fabric-based) towel (not shown in FIG. 2).

Figure 3:
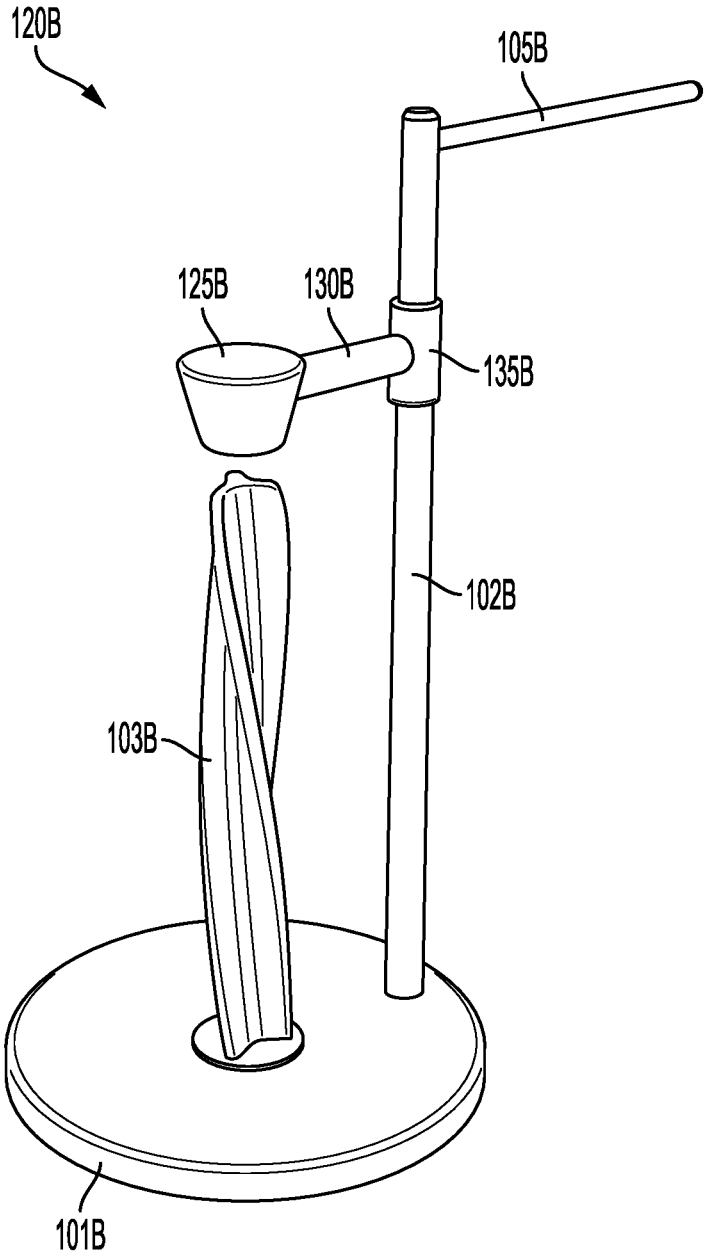
FIG. 3 illustrates an example consolidated towel rack or holder according to various embodiments of the present disclosure.

FIG. 3 illustrates an example consolidated towel rack or holder 120B according to various embodiments of the present disclosure. In FIG. 3, an example consolidated towel rack or holder 120B includes a base 101B, a first support member 102B, a second support member 103B, a weighted cap 125B, and a third support member 105B. The weighted cap 125B may be in contact with first support member 102B by way of a slide mechanism 135B. The weighted cap 125B may extend, via an extension member 130B, outwardly from first support member 102B. In various embodiments, the second support member 103B may be configured to receive and support a paper towel roll (not shown in FIG. 3). In at least the illustrated embodiment, the third support member 105B, in combination with the first support member 102B, may be configured to receive and support a (e.g., kitchen, hand, cloth, or fabric-based) towel (not shown in FIG. 3).

Figure 4:
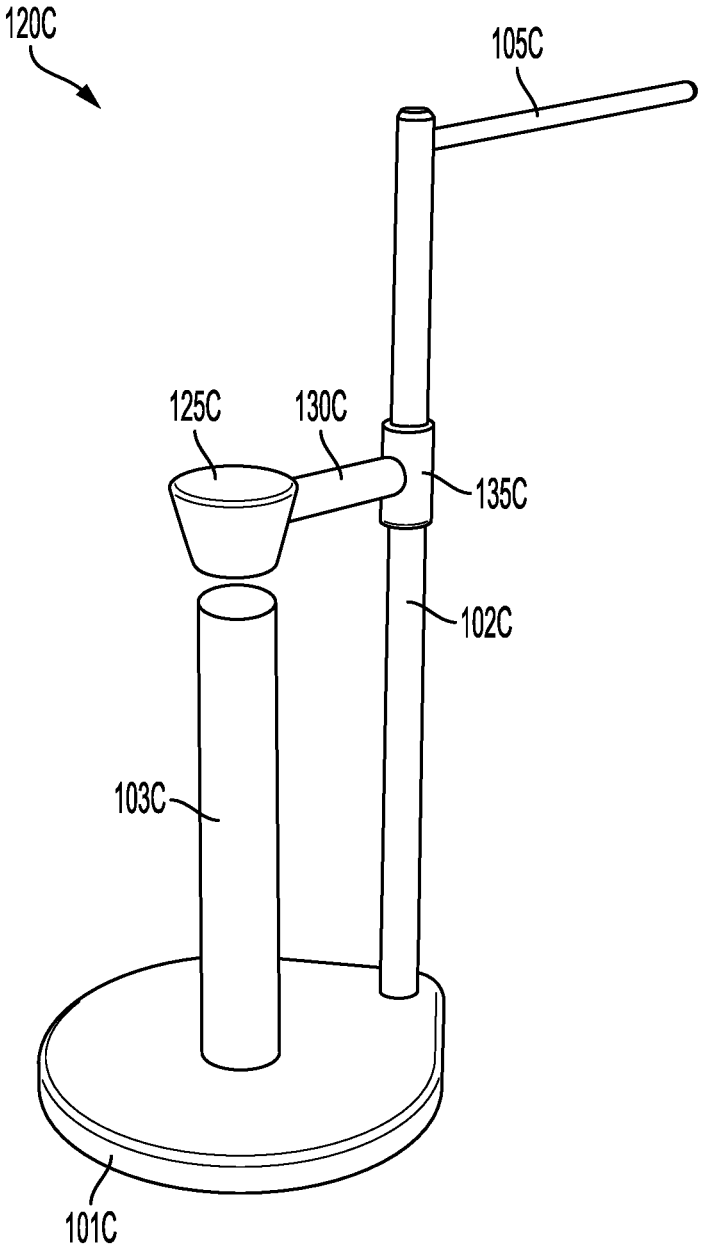
FIG. 4 illustrates an example consolidated towel rack or holder according to various embodiments of the present disclosure.

FIG. 4 illustrates an example consolidated towel rack or holder 120C according to various embodiments of the present disclosure. In FIG. 4, an example consolidated towel rack or holder 120C includes a base 101C, a first support member 102C, a second support member 103C, a weighted cap 125C, and a third support member 105C. The weighted cap 125C may be in contact with first support member 102C by way of a slide mechanism 135C. The weighted cap 125C may extend, via an extension member 130C, outwardly from first support member 102C. In various embodiments, the second support member 103C may be configured to receive and support a paper towel roll (not shown in FIG. 4). In at least the illustrated embodiment, the third support member 105C, in combination with the first support member 102C, may be configured to receive and support a (e.g., kitchen, hand, cloth, or fabric-based) towel (not shown in FIG. 4).

Figure 5:
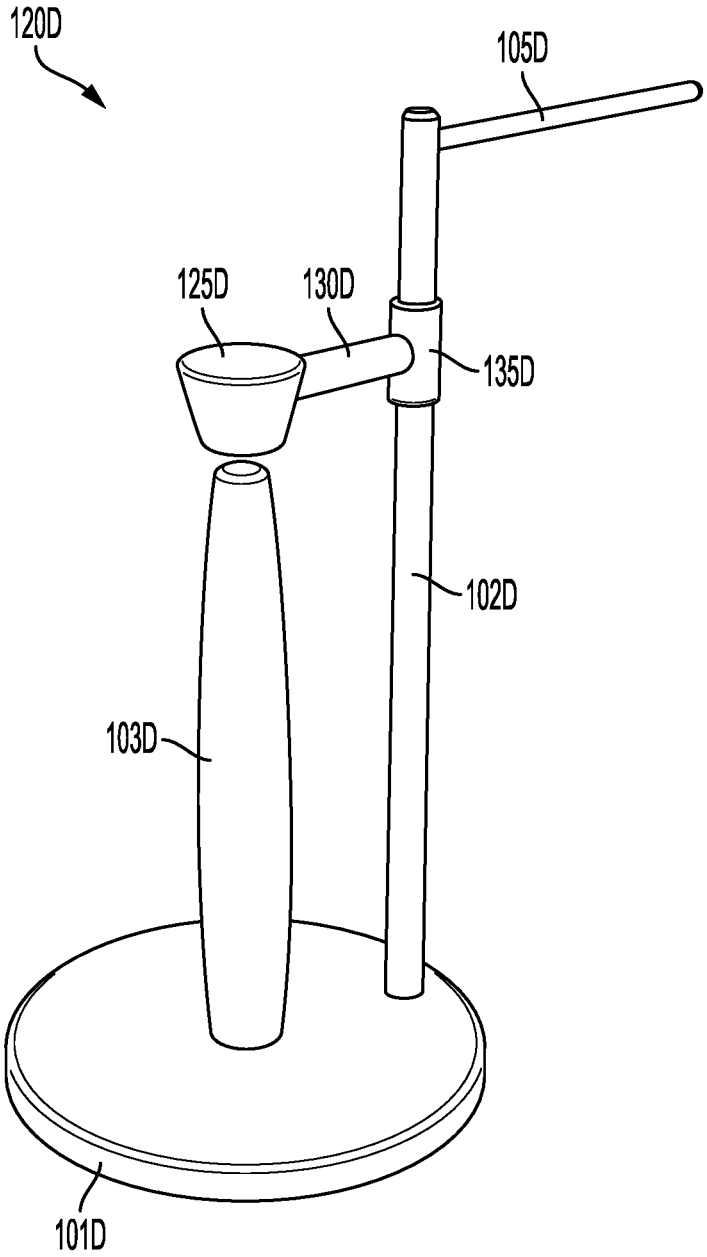
FIG. 5 illustrates an example consolidated towel rack or holder according to various embodiments of the present disclosure.

FIG. 5 illustrates an example consolidated towel rack or holder 120D according to various embodiments of the present disclosure. In FIG. 5, an example consolidated towel rack or holder 120D includes a base 101D, a first support member 102D, a second support member 103D, a weighted cap 125D, and a third support member 105D. The weighted cap 125D may be in contact with first support member 102D by way of a slide mechanism 135D. The weighted cap 125D may extend, via an extension member 130D, outwardly from first support member 102D. In various embodiments, the second support member 103D may be configured to receive and support a paper towel roll (not shown in FIG. 5). In at least the illustrated embodiment, the third support member 105D, in combination with the first support member 102D, may be configured to receive and support a (e.g., kitchen, hand, cloth, or fabric-based) towel (not shown in FIG. 5).

Figure 6:
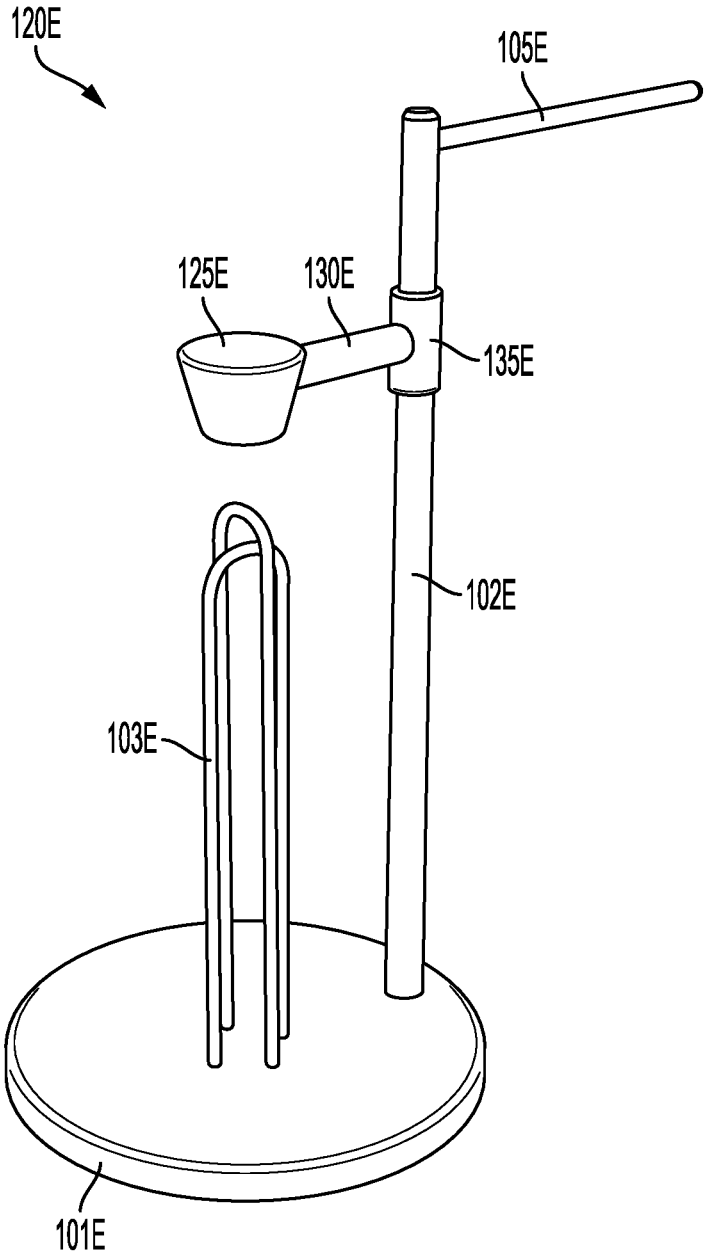
FIG. 6 illustrates an example consolidated towel rack or holder according to various embodiments of the present disclosure.

FIG. 6 illustrates an example consolidated towel rack or holder 120E according to various embodiments of the present disclosure. In FIG. 6, an example consolidated towel rack or holder 120E includes a base 101E, a first support member 102E, a second support member 103E, a weighted cap 125E, and a third support member 105E. The weighted cap 125E may be in contact with first support member 102E by way of a slide mechanism 135E. The weighted cap 125E may extend, via an extension member 130E, outwardly from first support member 102E. In various embodiments, the second support member 103E may be configured to receive and support a paper towel roll (not shown in FIG. 5). In at least the illustrated embodiment, the third support member 105E, in combination with the first support member 102E, may be configured to receive and support a (e.g., kitchen, hand, cloth, or fabric-based) towel (not shown in FIG. 6).

Figure 7A:
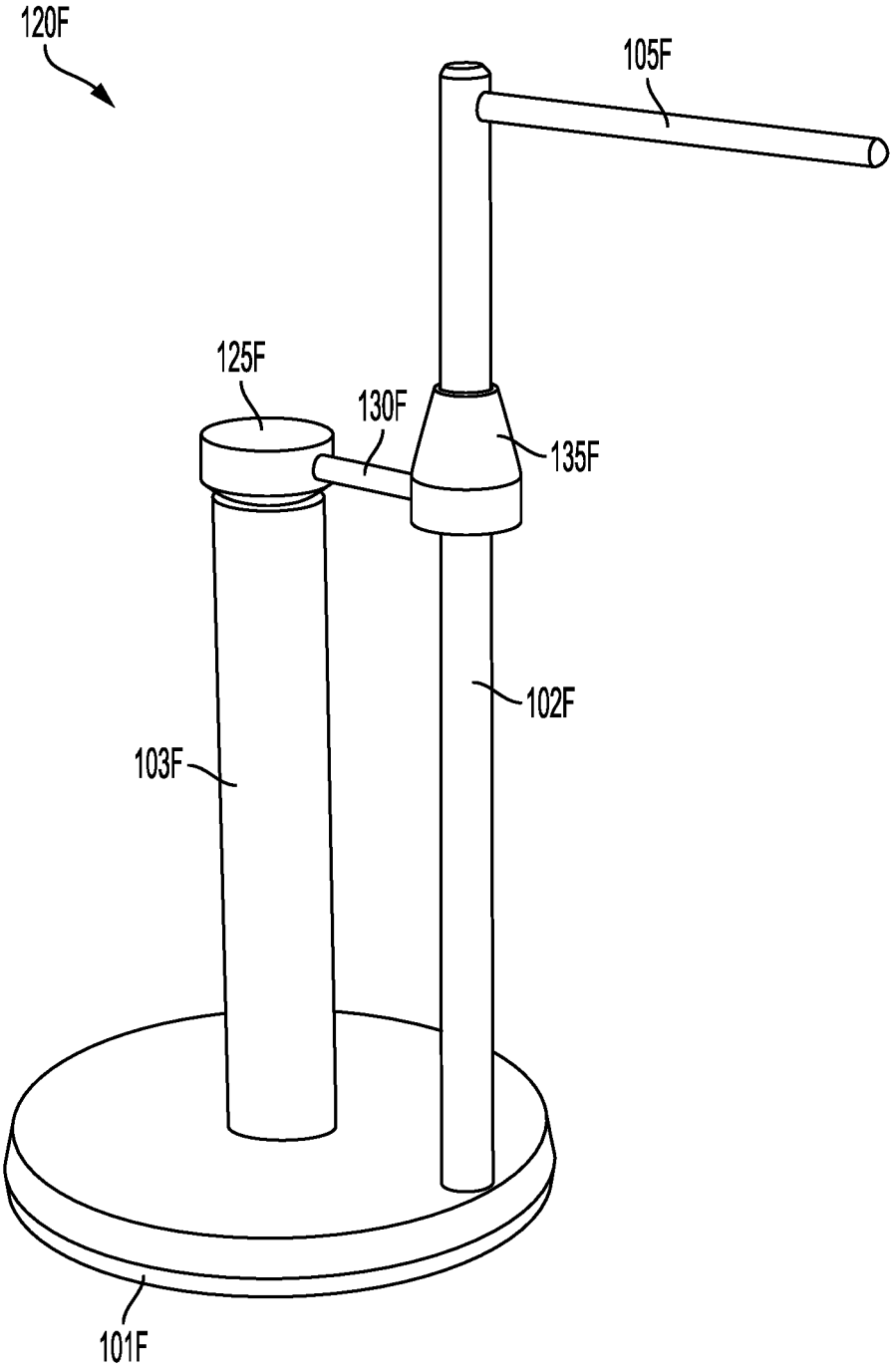
FIGS. 7A and 7B illustrate an example consolidated towel rack or holder according to various embodiments of the present disclosure.
Figure 7B:
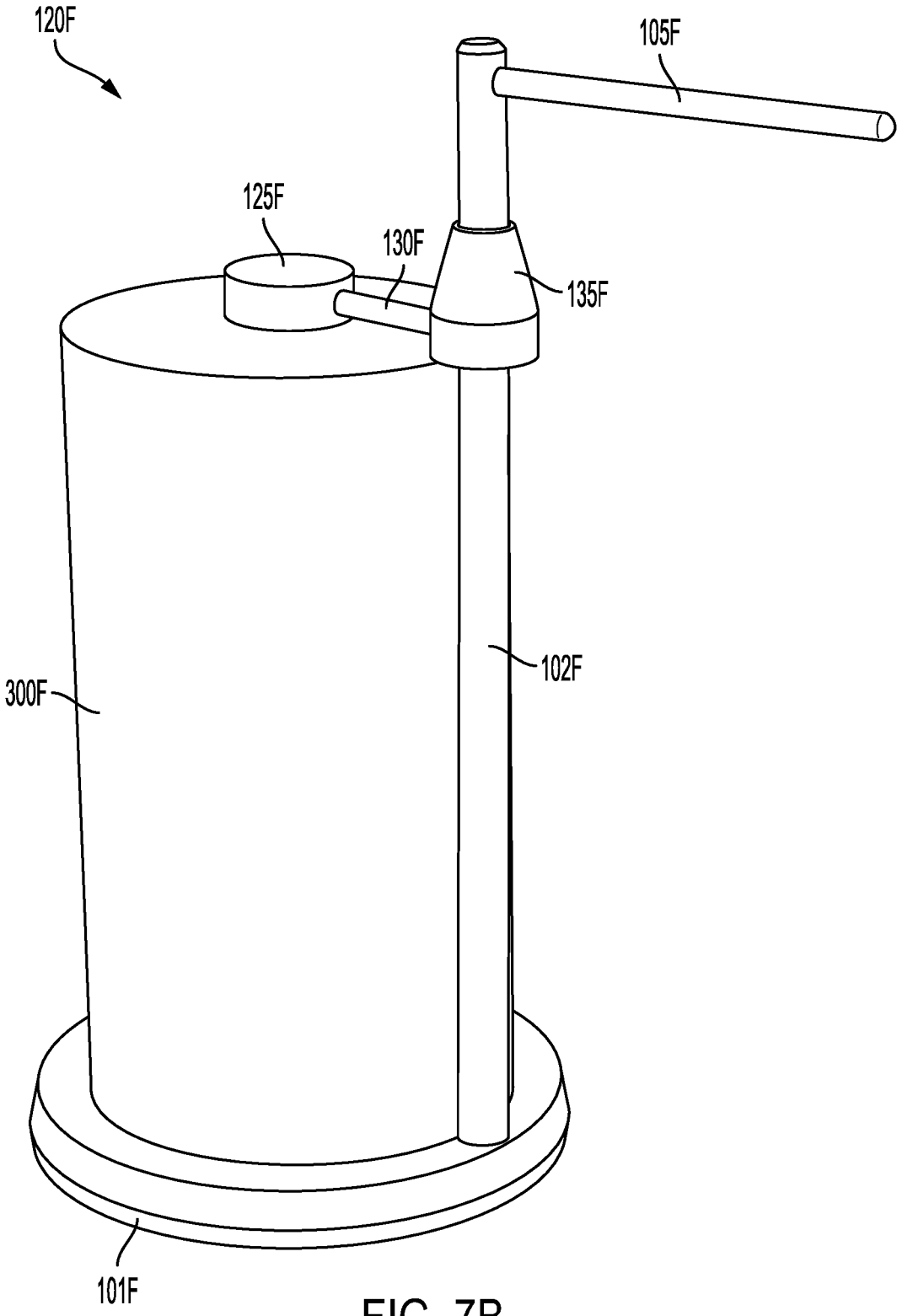

FIGS. 7A and 7B illustrate an example consolidated towel rack or holder 120F according to various embodiments of the present disclosure. In FIGS. 7F and 7B, an example consolidated towel rack or holder 120F includes a base 101F, a first support member 102F, a second support member 103F, a weighted cap 125F, and a third support member 105F. The weighted cap 125F may be in contact with first support member 102F by way of a slide mechanism 135F. The weighted cap 125F may extend, via an extension member 130F, outwardly from first support member 102F. In various embodiments, the second support member 103F may be configured to receive and support a paper towel roll 300F. In at least the illustrated embodiment, the third support member 105F, in combination with the first support member 102F, may be configured to receive and support a (e.g., kitchen, hand, cloth, or fabric-based) towel (not shown in FIGS. 7F and 7B).

Figure 8:
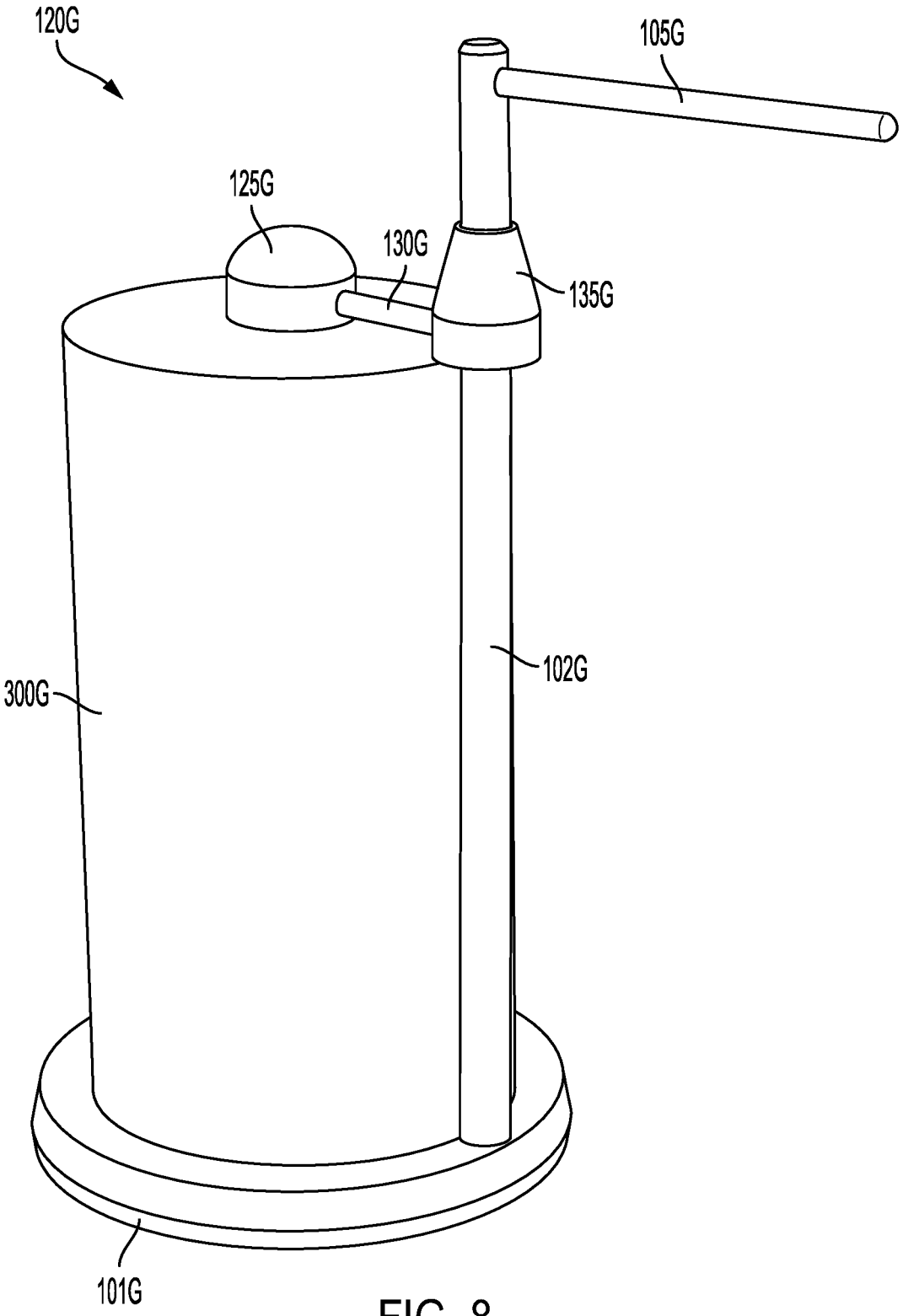
FIG. 8 illustrates an example consolidated towel rack or holder according to various embodiments of the present disclosure.
Figure 9A:
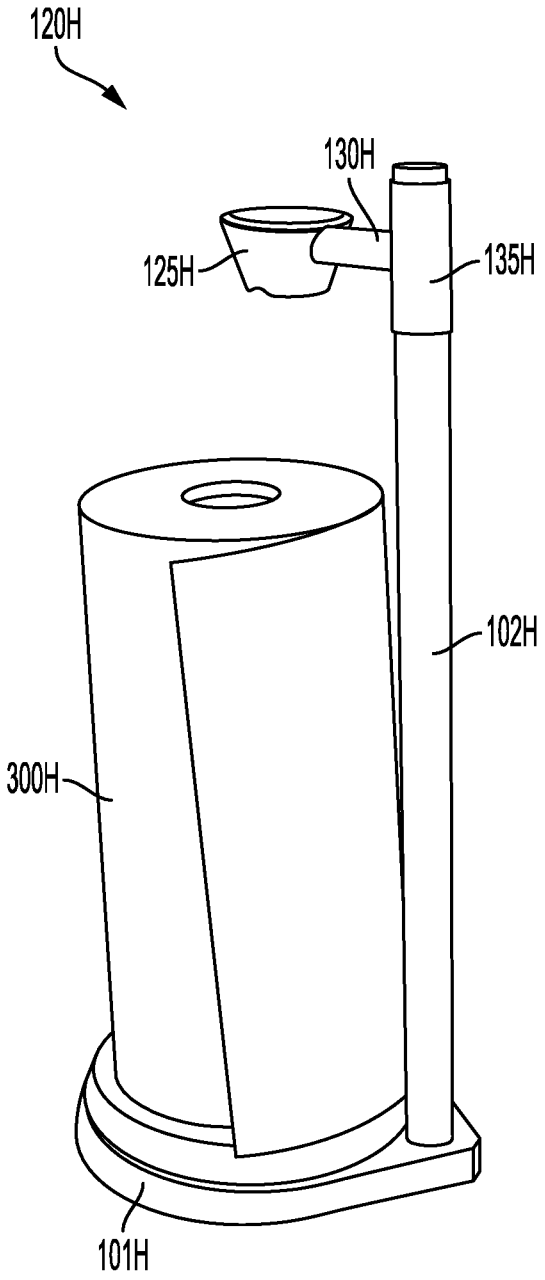
FIGS. 9A, 9B, 9C, and 9D illustrate an example consolidated towel rack or holder according to various embodiments of the present disclosure.
Figure 9B:
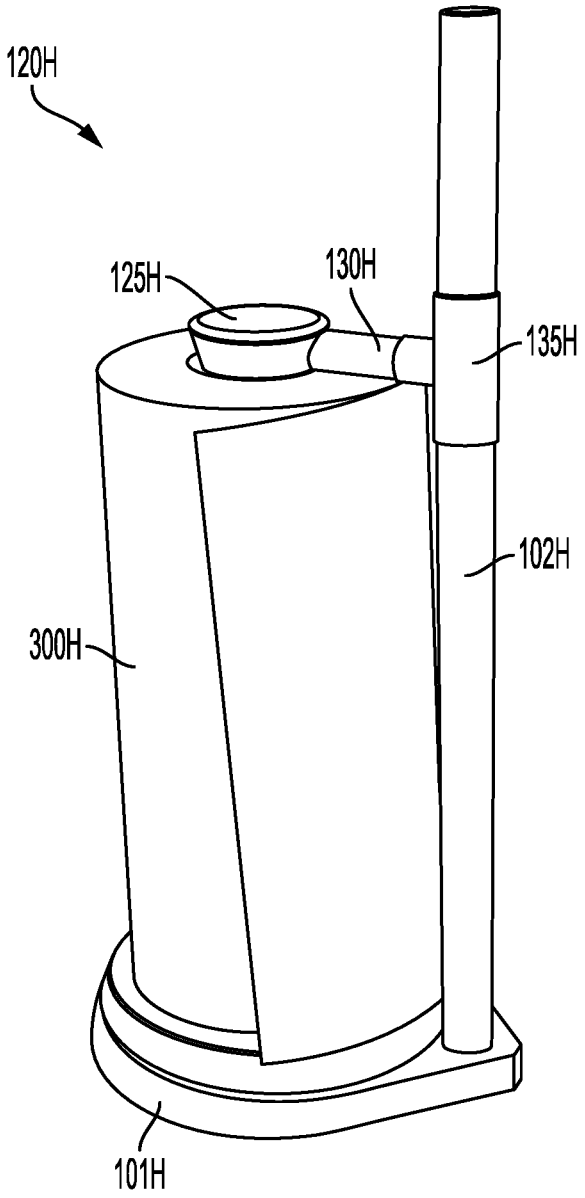
Figure 9C:
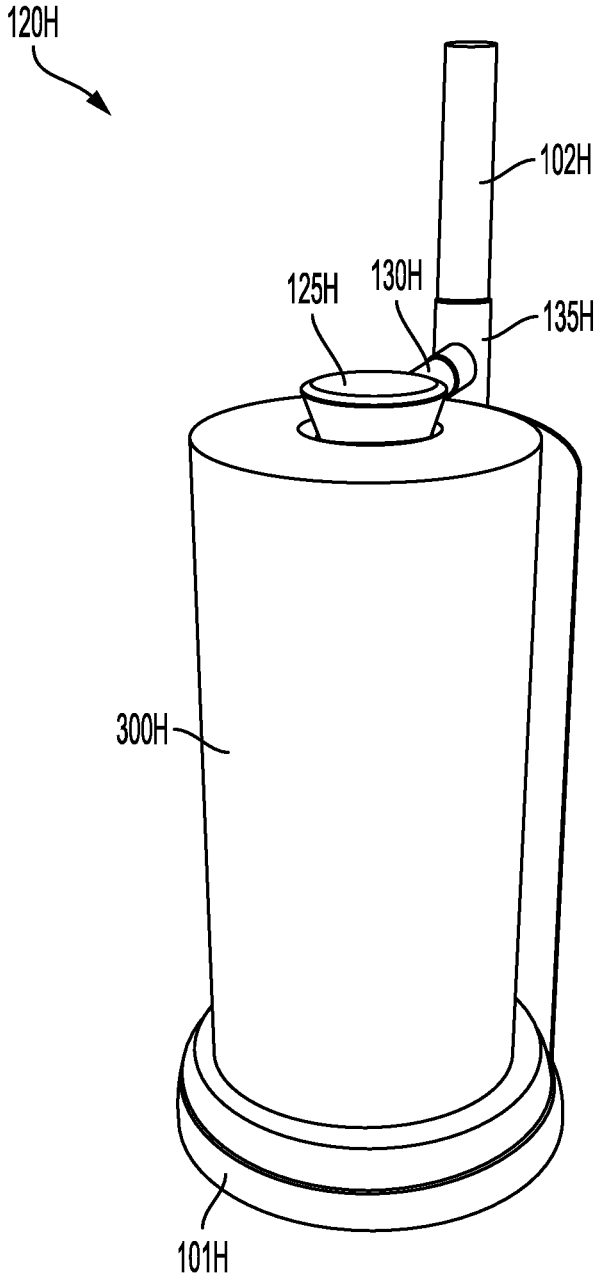
Figure 9D:
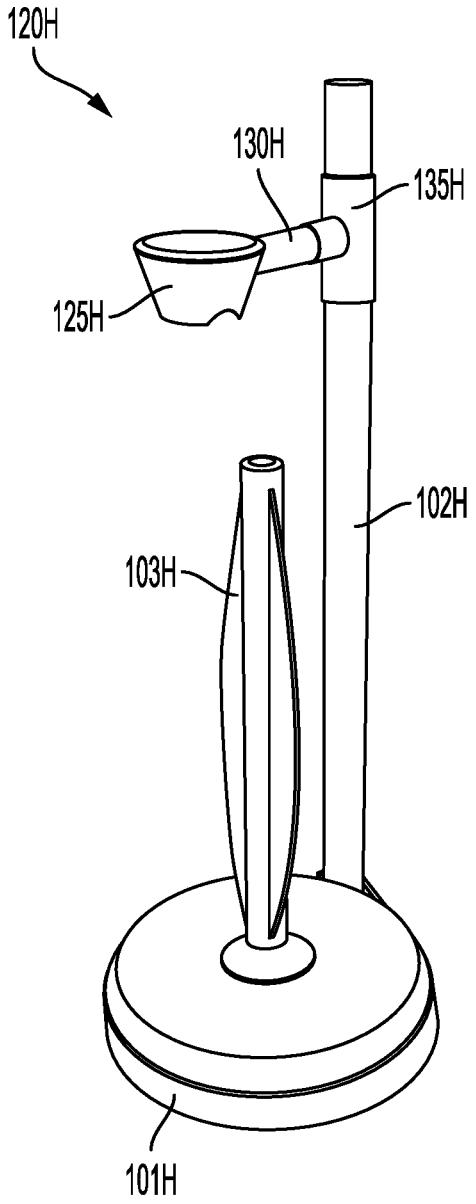

FIG. 8 illustrates an example consolidated towel rack or holder 120G according to various embodiments of the present disclosure. In FIG. 8, an example consolidated towel rack or holder 120G includes a base 101G, a first support member 102G, a second support member 103G, a weighted cap 125G, and a third support member 105G. The weighted cap 125G may be in contact with first support member 102G by way of a slide mechanism 135G. The weighted cap 125G may extend, via an extension member 130G, outwardly from first support member 102G. In various embodiments, the second support member 103G may be configured to receive and support a paper towel roll 300G. In at least the illustrated embodiment, the third support member 105G, in combination with the first support member 102G, may be configured to receive and support a (e.g., kitchen, hand, cloth, or fabric-based) towel (not shown in FIG. 8).

FIGS. 9A, 9B, 9C, and 9D illustrate an example consolidated towel rack or holder 120H according to various embodiments of the present disclosure. In FIGS. 9A, 9B, 9C, and 9D, an example consolidated towel rack or holder 120H includes a base 101H, a first support member 102H, a second support member 103H, and a weighted cap 125H. The weighted cap 125H may be in contact with first support member 102H by way of a slide mechanism 135H. The weighted cap 125H may extend, via an extension member 130H, outwardly from first support member 102H. In various embodiments, the second support member 103H may be configured to receive and support a paper towel roll 300G. In at least one embodiment, an optional third support member (not shown in FIGS. 9A-9D), in combination with the first support member 102H, may be configured to receive and support a (e.g., kitchen, hand, cloth, or fabric-based) towel (not shown in FIGS. 9A-9D).

The weighted cap (e.g., 125A-125H) may be configured such that it rests, based on gravity, on a paper towel roll (e.g., 300G). While the weighted cap (e.g., 125A-125H) is gravitationally resting on the paper towel roll, the paper towel roll may still easily rotate or be rotated around the first support member (e.g., 102A-102H). That is, the weighted cap (e.g., 125A-125H) has dimensions so that it provides enough weight to stabilize the paper towel roll in place around the first support member while enabling free and easy rotation of the paper towel roll around the first support member. The dimensions of the weighted cap are further such that the weighted cap, along with the extension member, may be freely and easily moved in a direction away from the paper towel roll (e.g., in a direction upward along the third support member, e.g., 103A-103H)) via the slide mechanism to enable easy replacement or adjustment of the paper towel roll. Weighted caps described herein may be rotatable around an axis of a first support member such that it may pivot, along with its extension member and sliding mechanism, relative to the first support member.

It will be understood that although throughout this disclosure it is envisioned that a kitchen towel or the like is coupled with the paper towel roll, any of a variety of alternative towels or other cleaning-related items could be supported by the various described and depicted, as desirable.

In various embodiments, the bases (e.g., 101A-101H) described and depicted herein may be largely planar and largely circular in shape. Alternative shapes may, however, be envisioned, without departing from the scope of the present invention, including oval, rectangular, square, or even triangle shaped. Indeed, any of a variety of any shapes and sizes of bases suitable for paper towel holders may be utilized without departing from the scope of the present disclosure. The base may also be partially hollow, for receiving (and hiding) screws or attachment mechanisms for one or both of the first and second support members (e.g., 102A-102H), (e.g., 103A-103H). The base (e.g., 101A-101H) may also be partially solid or otherwise weighted, in part for stability. Non-limiting examples of materials for the base (e.g., 101A-101H) may include brass, stainless, aluminum, plastic, or the like. A weight of the base (e.g., 101A-101H) may range between one and four pounds, although certain embodiments may include a base weight either slightly more or less than this range, as may be desirable. In certain embodiments, a non-skid (e.g., rubber or the like) pad may be provided on an underside of the base (e.g., 101A-101H), so as to provide further stability and immobility of the consolidated towel rack or holder (e.g., 120A-120H).

According to various embodiments, the second support member (e.g., 103A-103H) may be configured to selectively and releasably attach to the base (e.g., 101A-101H). In at least one embodiment, the second support member (e.g., 103A-103H) may be centrally positioned on the base (e.g., 101A-101H), for example radially centrally in the illustrated embodiment having a largely circular-shaped base (e.g., 101A-101H). Example diameters of the base (e.g., 101A-101H) (e.g., where circular-shaped) may range from six inches to 18 inches. Of course, smaller or larger diameter bases may be provided, if desired. One exemplary and preferred base diameter is 7.5 inches. One exemplary base diameter range includes 7.5 inches to 8 inches. In embodiments, a diameter of the base is configured to at least exceed a diameter of a paper towel roll while also including space for the first support member positioned outside the diameter of the paper towel roll.

According to various embodiments, the second support member (e.g., 103A-103H) may be constructed from the same or different materials than the base and may be partially solid and/or hollow as desirable. Exemplary materials for the second support member 103A mirror those previously detailed herein for the base (e.g., 101A-101H). A length of the second support member (e.g., 103A-103H) may range from 10 to 18 inches. One exemplary preferred length of the second support member is 14.5 inches, although it should be understood that longer or shorter lengths may be provided, as desirable.

Figure 13:
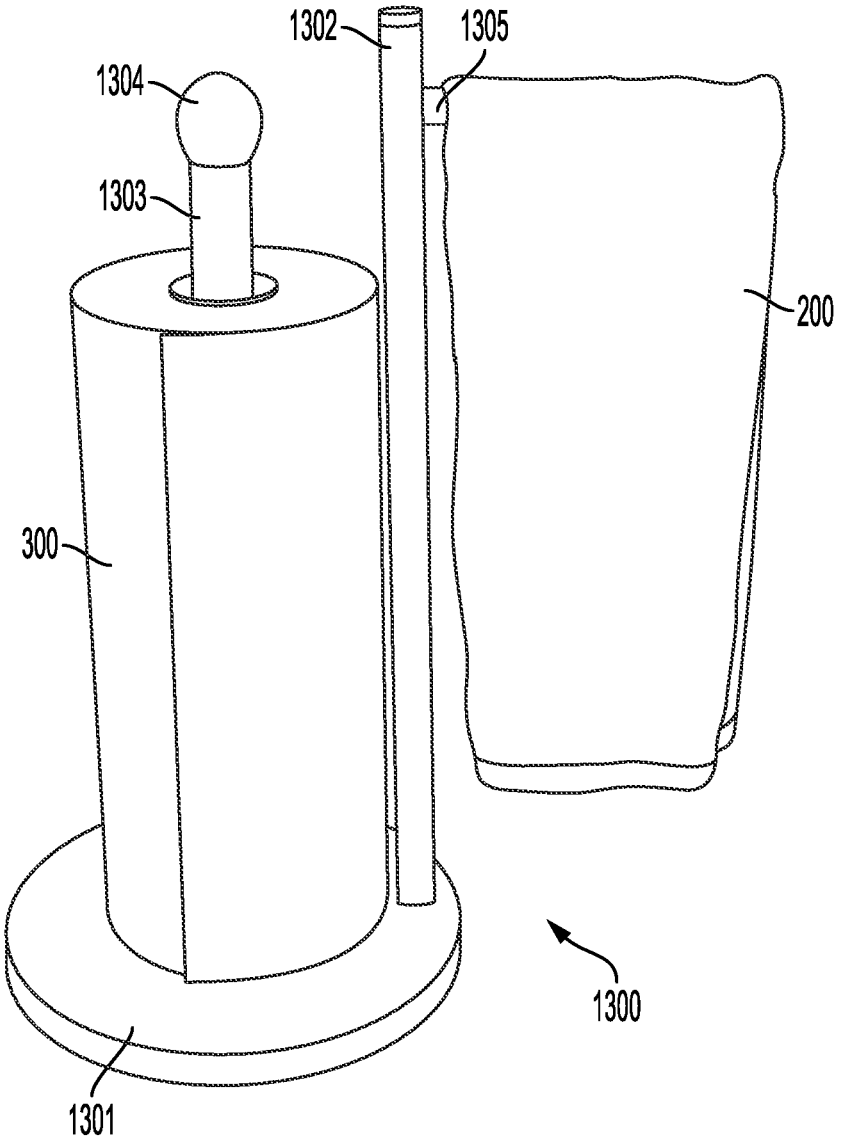
FIG. 13 illustrates an example consolidated towel rack or holder according to various embodiments of the present disclosure.
Figure 14:
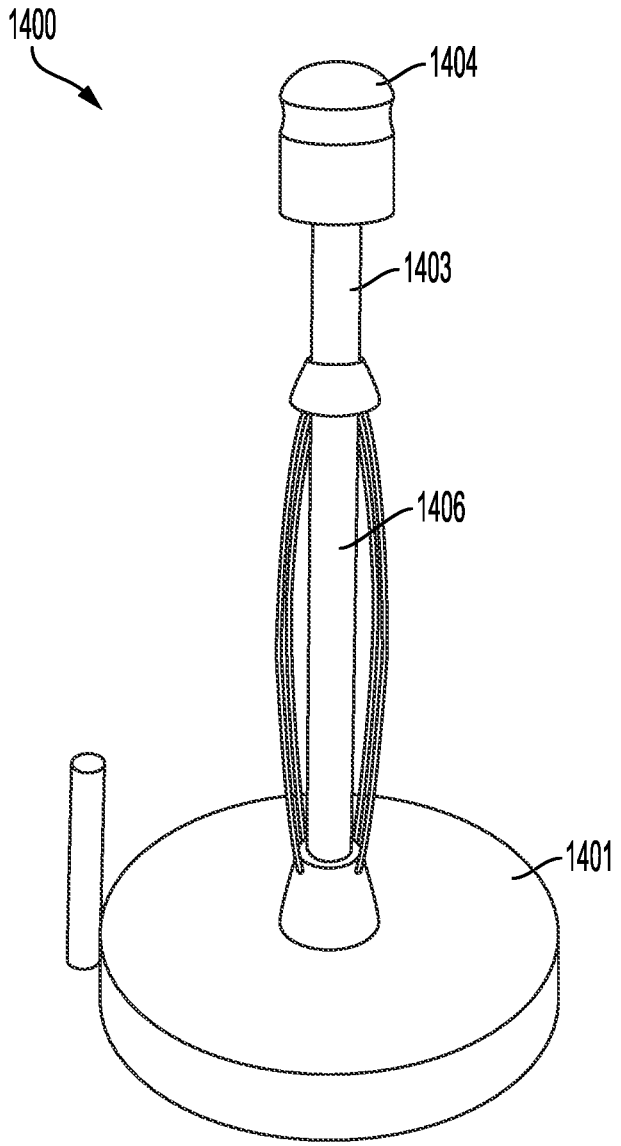
FIG. 14 illustrates an example consolidated towel rack or holder according to various embodiments of the present disclosure.

In certain embodiments, as illustrated in FIGS. 13-14, the second support member (e.g., 103A-103H, 1303, 1403) may also have a cap (e.g., 1304, 1404) affixed to one end thereof, to prevent inadvertent removal of the paper towel roll 300 therefrom, when supported. The cap (e.g., 1304, 1404) may be integrated with the second support member (e.g., 103A-103H, 1303, 1403) or selectively attachable thereto. Certain embodiments may have a cap (e.g., 1304, 1404) that is of the same size or diameter as the second support member (e.g., 103A-103H, 1303, 1403) by way of contrast with the enlarged size and shape of the cap (e.g., 1304, 1404) illustrated in FIGS. 13-14. Any of a variety of sizes and shapes of caps may be envisioned, again without departing from the scope and nature of the present invention.

According to various embodiments, the first support member (e.g., 102A-102H) may be configured to selectively and releasably attach to the base (e.g., 101A-101H). In at least one embodiment, the first support member (e.g., 102A-102H) may be attached at an offset position on the base, for example at a radially outward (e.g., perimeter adjacent) location in the illustrated embodiment having a largely circular-shaped base (e.g., 101A-101H). Exemplary diameters of the base (where circular-shaped) may range from six inches to 18 inches. Of course, smaller or larger diameter bases may be provided, if desired. Where larger diameters may be utilized, the first support member (e.g., 102A-102H) position may be intermediate a centralized location and the perimeter.

According to various embodiments, the first support member (e.g., 102A-102H) may be constructed from the same or different materials than the base and/or the second support member (e.g., 103A-103H); and may be partially solid and/or hollow as desirable. Exemplary materials for the first support member (e.g., 102A-102H) may mirror those previously detailed herein for the base (e.g., 101A-101H). A length of the first support member (e.g., 102A-102H) may range from 12 to 18 inches, alternatively 14 to 21 inches. One exemplary preferred length of the first support member is 16 inches, although it should be understood that longer or shorter lengths may be provided, as desirable. Generally, the length of the first support member (e.g., 102A-102H) is greater than the length of the second support member (e.g., 103A-103H), although the two may be equal in certain embodiments, provided both lengths are greater than a conventional paper towel roll (e.g., 300) length.

The first and second support members (e.g., 102A-102H), (e.g., 103A-103H) are, in various embodiments, largely parallel relative to one another. In certain embodiments, the first support member (e.g., 102A-102H) is spaced axially apart from the second support member (e.g., 103A-103H) by a distance approximately equal to a radius of a conventional paper towel roll 300 (e.g., as illustrated in FIG. 13). In this manner, the first support member (e.g., 102A-102H) may provide exterior support and/or guidance for the outermost layer of the paper towel roll 300.

In certain embodiments, the first support member (e.g., 102A-102H) may also have a cap (e.g., or weighted cap) affixed to one end thereof, although it is optional. The cap may be integrated with the first support member (e.g., 102A-102H) or selectively attachable thereto. Certain embodiments may have a cap that is of the same size or diameter as the first support member (e.g., 102A-102H), by way of contrast with the enlarged size and shape of the cap (e.g., 1304, 1404) illustrated in FIGS. 13-14 and provided on the second support member (e.g., 103A-103H). Any of a variety of sizes and shapes of caps may be envisioned, again without departing from the scope and nature of the present invention.

According to various embodiments, the third support member (e.g., 105A-105G) is attached to or integral with the first support member (e.g., 102A-102H). As should be understood, the third support member (e.g., 105A-105G) is substantially perpendicular to the first support member (e.g., 102A-102H) and also a plane within the base (e.g., 101A-101H) lies (e.g., a table or counter plane, or support surface plane). In certain embodiments, the third support member (e.g., 105A-105G) is attached to or integral with a location on the first support member (e.g., 102A-102H) that is between 12 and 16 inches from the base or table plane. One preferred distance is 14.5 inches from the base. It will be appreciated that greater or smaller distances may be chosen, as desired.

A length of the third support member (e.g., 105A-105G) may range from four to eight inches, more preferably from 5.5 to 6 inches in length. A diameter of the third support member (e.g., 105A-105G) may match that of the first support member (e.g., 102A-102H) and/or the second support member (e.g., 103A-103H); alternatively, different diameters may be provided for each member. In at least the illustrated embodiment, the third support member (e.g., 105A-105G) has the smallest diameter and the second support member (e.g., 103A-103H) has the largest, with the first support member (e.g., 102A-102H) being intermediary. All members may be circular, as illustrated, partially or entirely hollow; alternatively, one or more members may be partially or entirely solid and/or otherwise shaped (e.g., triangular, tubular, cubed, square, or rectangular or otherwise).

A length of a fourth support member may range from four to eight inches, more preferably from 5.5 to 6 inches in length. A diameter of the fourth support member may match that of the first support member and/or the second support member and/or the third support member; alternatively, different diameters may be provided for each member. In some embodiments, the third and fourth support members have the smallest diameter relative to the first and second support members. All members may be circular, as illustrated, partially or entirely hollow; alternatively, one or more members may be partially or entirely solid and/or otherwise shaped (e.g., triangular, tubular, cubed, square, or rectangular or otherwise).

Figure 12A:
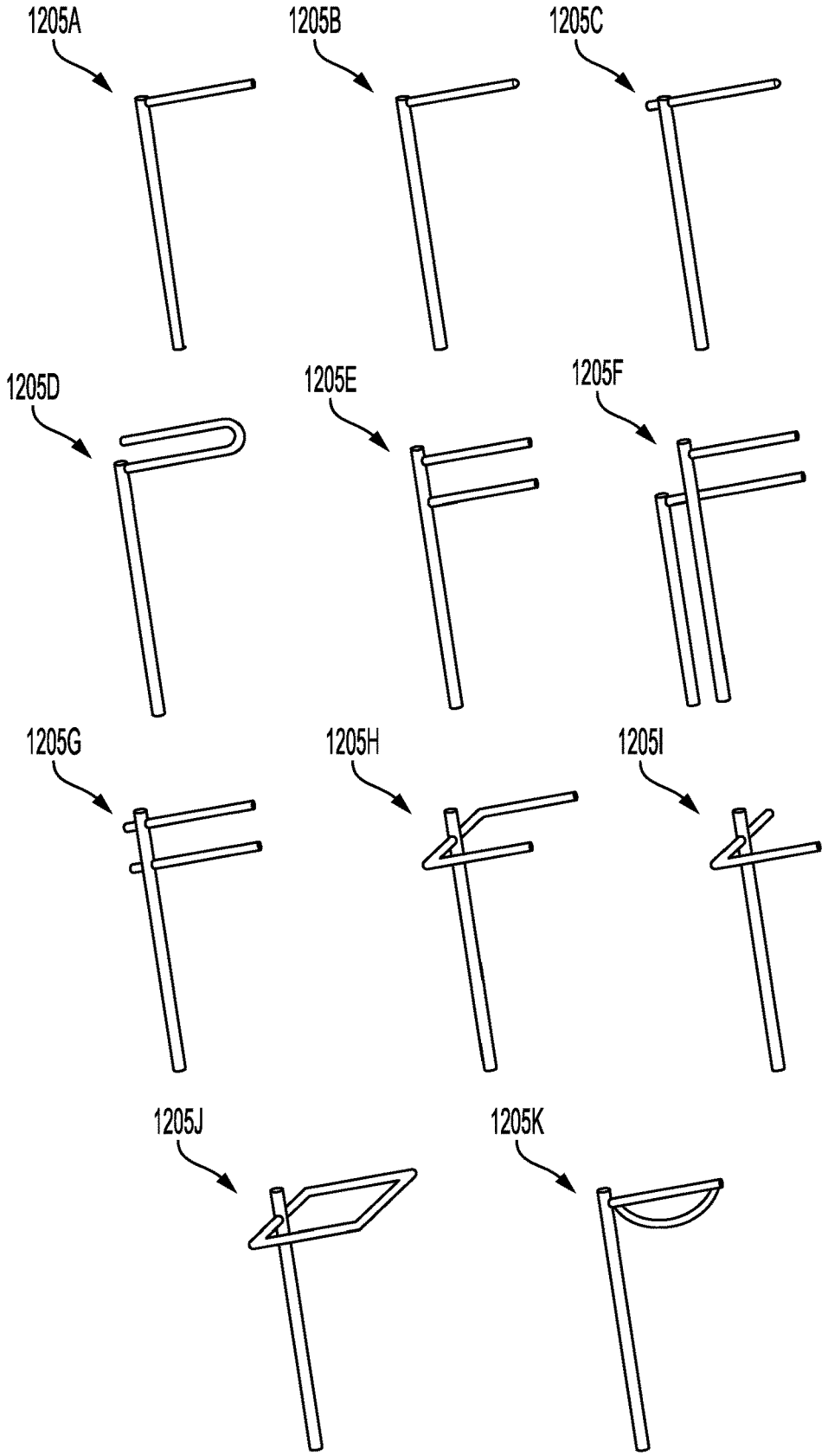
FIGS. 12A-12B illustrate an example consolidated towel rack or holder according to various embodiments of the present disclosure.

Multiple possible embodiments (e.g., 1205A-1205K) of the third support member (e.g., 105A-105G) may be seen in FIG. 12A. A first is member 1205A, where the third support member (e.g., 105A-105G) and the first support member (e.g., 102A-102H) are squared-off relative to one another. This may be contrasted with other embodiments depicted herein, where the third support member (e.g., 105A-105G) is not located at an end of the first support member (e.g., 102A-102H), but instead offset a distance therefrom. This embodiment of member 1205A may also have a lip at a distal end of the member to, in part, retain the towel 200 thereon.

Another embodiment is member 1205B, which is rounded on its ends, optionally with a knob on the end. Another analogous embodiment is member 1205C, wherein instead of the third support member (e.g., 105A-105G) being attached to and ending at the first support member (e.g., 102A-102H), the former extends an opposing distance beyond the first support member (e.g., 102A-102H). A cantilever-type configuration may be provided. Smaller items may be supported by the opposing distance offset; or the offset may assist with retention of the paper towel roll 300 (not shown) positioned adjacent thereto.

Member 1205D illustrates another possible embodiment, wherein the third support member (e.g., 105A-105G) may not be a single-axis member as with prior described embodiments. Instead, a half or ¾ ovular or circular member may be provided. This may be compared with members 1205H, 1205I, and 1205J, which are similarly not single-axis members; nor are they semi-circular. Instead, square, or rectangular shapes may be provided for members 1205H, 1205I, and 1205J, whether to support multiple towels (not shown in FIG. 12A) or to support the same in different desirable manners. In this regard, the shapes for members 1205H, 1205I, and 1205J may be open-sided or fully closed.

Members 1205E, 1205F, and 1205G illustrate embodiments where the third support member (e.g., 105A-105G) may comprise two or more support members, configured relative to the first support member (e.g., 102A-102H) as previously discussed herein. Two support members may in certain embodiments both extend from the first support member (e.g., 102A-102H). In other embodiments, such as that of member 1205F, a duplicate first support member may be provided.

Member 1205K illustrates an additional embodiment, with a loop-type configuration for the third support member (e.g., 105A-105G), through an opening of which the towel (not shown in FIG. 12A) may be received. Loop-type configurations of this style may have portions of the opening that are smaller than others, so as to selectively retain and/or immobilize the towel (not shown in FIG. 12A) once placed therethrough. Others may permit free passive movement of the towel therethrough, or over a top portion of the loop.

Figure 12B:
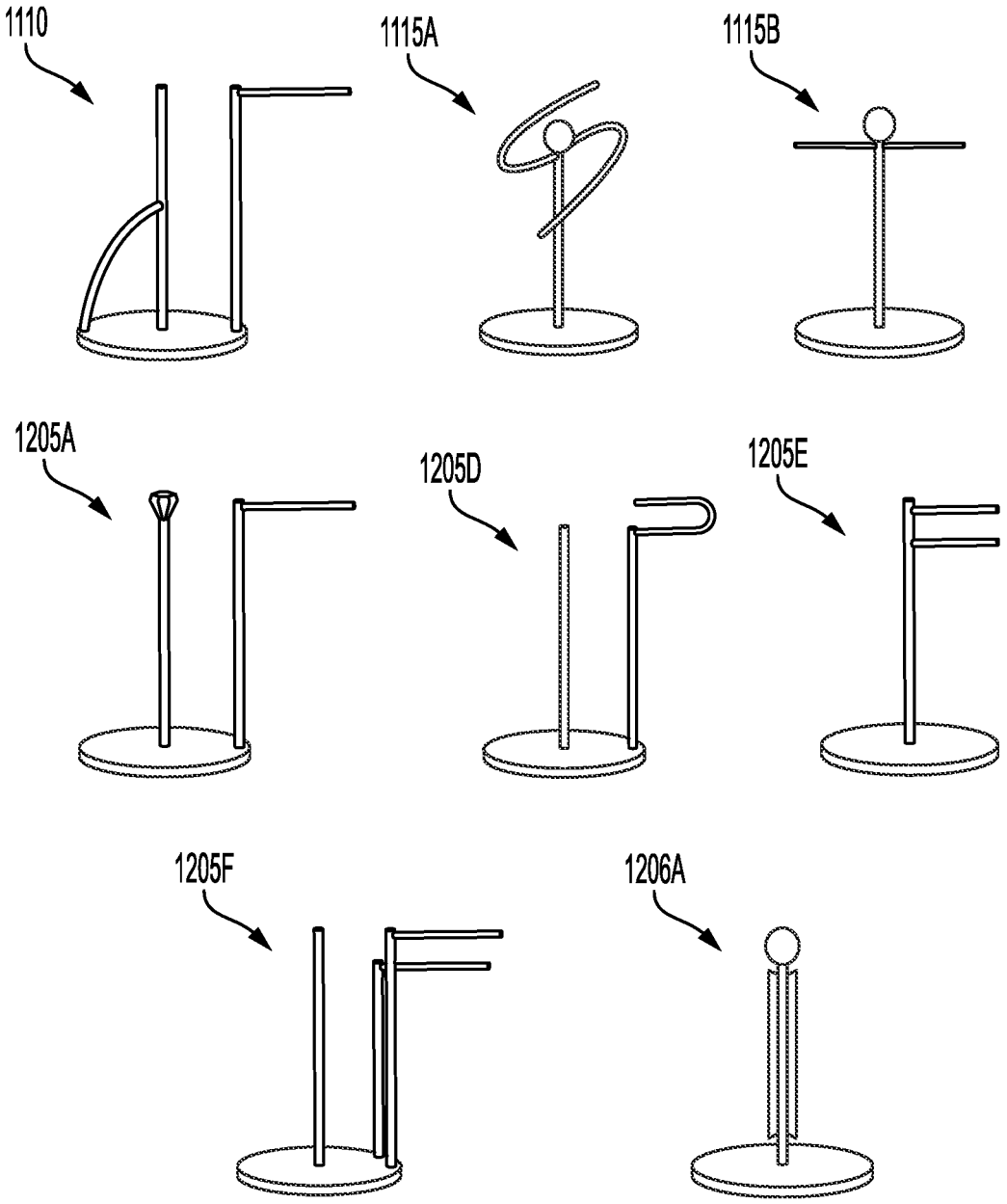

FIG. 12B illustrates a handful of still further embodiments, along with different views of members 1205A, 1205D, 1205E, and 1205F. One possibility further is member 1115A, whereby the third support member (e.g. 105A-105G) may be suspended or otherwise selectively attached to the second support member (e.g., 103A-103H) (e.g., the member supporting the paper towel roll itself). In at least this embodiment, the first support member (e.g., 102A-102H) may be eliminated. One disadvantage, though, as compared to the embodiments detailed previously herein, is that the member 1115A would need to be selectively removed each time a new paper towel roll (not shown in FIG. 12B) is required. This may be contrasted with mounting of analogous members to a separate first support member (e.g., 102A-102H), adjacent an outer perimeter of the paper towel roll (not shown in FIG. 12B). Member 1115B is another embodiment analogous to that with member 1115A.

With reference to FIG. 12B, in certain embodiments the second support member may also be provided with a ratchet-type spinner 1206A or a comparable mechanism to prevent and/or otherwise control rotation of the paper towel roll placed onto the second support member. An alternative configuration, having grip-providing bars 1406 may be seen in FIG. 14.

Figure 10:
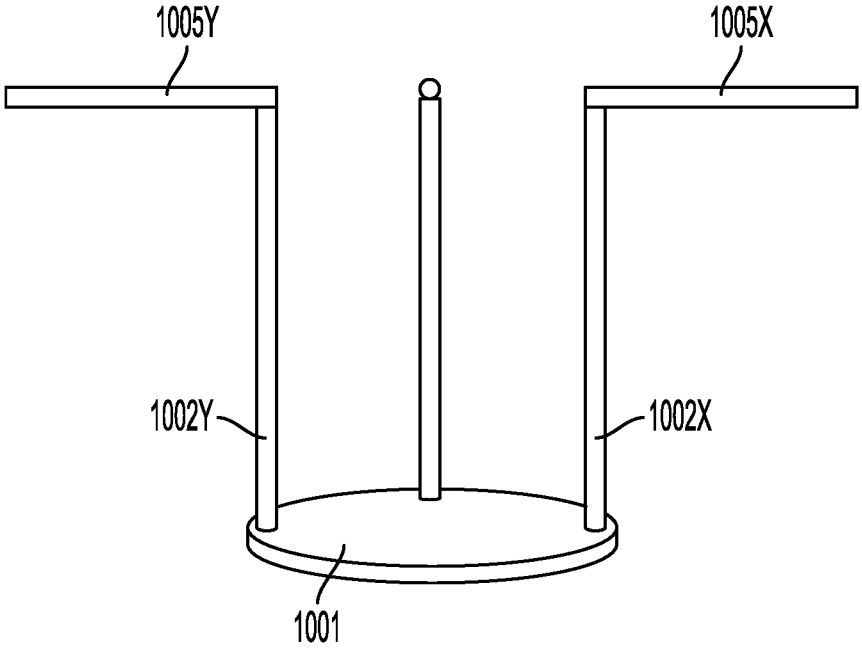
FIG. 10 illustrates an example consolidated towel rack or holder according to various embodiments of the present disclosure.

FIG. 10 illustrates an example consolidated towel rack or holder according to various embodiments of the present disclosure. In FIG. 10, instead of a single third support member (e.g., 105A-105G), multiple (e.g., a pair or more) of third support members 1005X, 1005Y may be provided. The pair of members 1005X, 1005Y may be positioned on opposing sides of the base 1001, supported by an opposing positioned pair of first support members 1002X, 1002Y. Although a pair of members 1002X, 1002Y, and 1005X and 1005Y is illustrated, in an opposing manner, it should be understood that still further members or sets of members may be provided. For example, three support members (e.g., not shown but for each of 1002 and 1005) could be provided; each may be equally spaced around a perimeter of the base 1001. In other embodiments, the two or three (or more) support members (e.g., not shown but for each of 1002, 1005) may be unevenly distributed around the perimeter of the base 1001, as desirable.

Figure 11A:
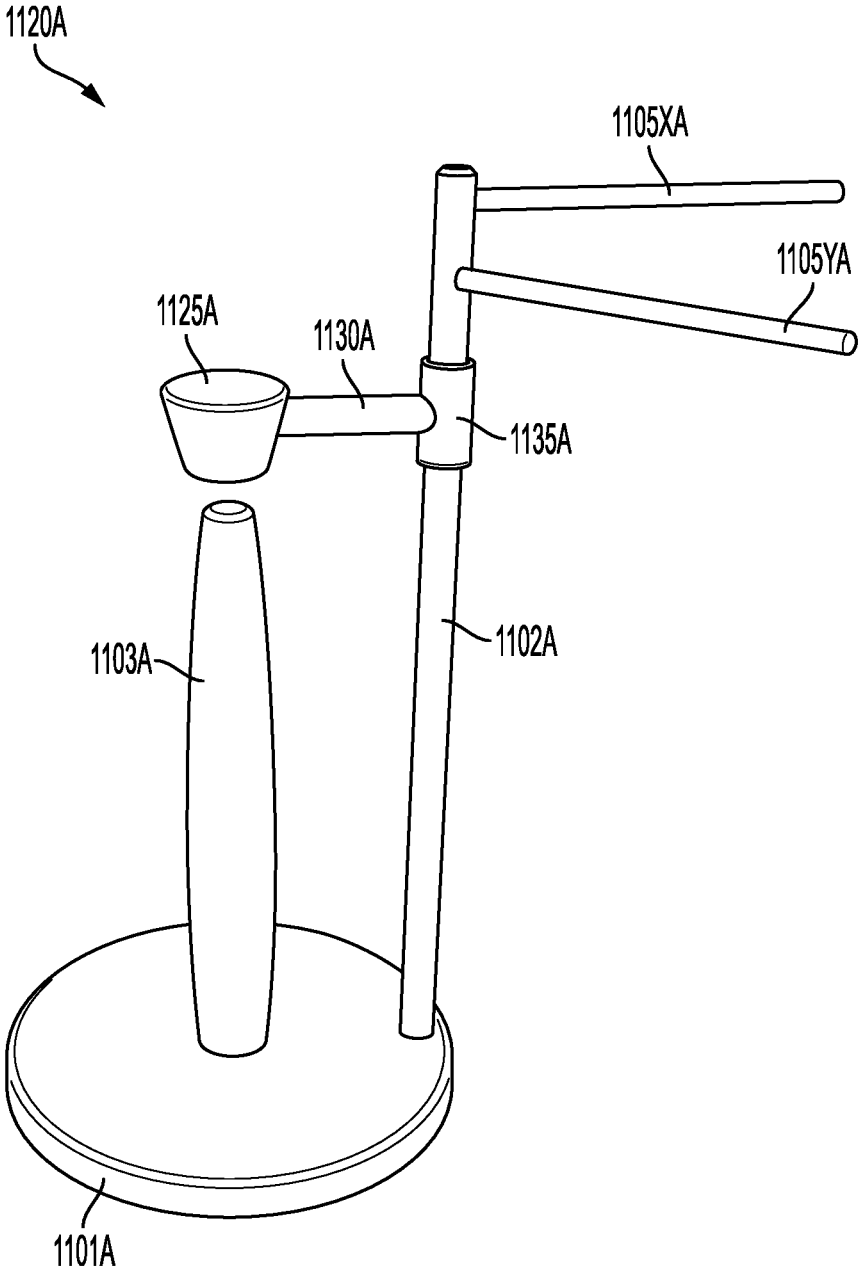
FIGS. 11A-11B illustrate example consolidated towel racks or holders according to various embodiments of the present disclosure.

FIG. 11A illustrates an example consolidated towel rack or holder according to various embodiments of the present disclosure. In FIG. 11A, an example consolidated towel rack or holder 1120_A includes a base 1101_A, a first support member 1102_A, a second support member 1103_A, a weighted cap 1125_A, a third support member 1105X_A, and a fourth support member 1105Y_A. The weighted cap 1125_A may be in contact with first support member 1102_A by way of a slide mechanism 1135_A. The weighted cap 1125_A may extend, via an extension member 1130_A, outwardly from first support member 1102_A. In various embodiments, the second support member 1103_A may be configured to receive and support a paper towel roll (not shown in FIG. 11A). In at least the illustrated embodiment, the third support member 1105X_A, in combination with the first support member 1102_A, may be configured to receive and support a (e.g., kitchen, hand, cloth, or fabric-based) towel (not shown in FIG. 11A). In at least the illustrated embodiment, the fourth support member 1105Y_A, in combination with the first support member 1102_A, may be configured to receive and support another towel (not shown in FIG. 11A). It will be appreciated that third support member 1105X_A and fourth support member 1105Y_A may be positioned relative to one another according to a space between them horizontally as well as another space or distance between them vertically along the first support member 1102_A. In various embodiments, one or more of the third support member 1105X_A or the fourth support member 1105Y_A may have a fixed position on the first support member 1102_A or may pivotable around an axis of the first support member 1102_A such that they are rotatable relative to the first support member 1102_A.

Figure 11B:
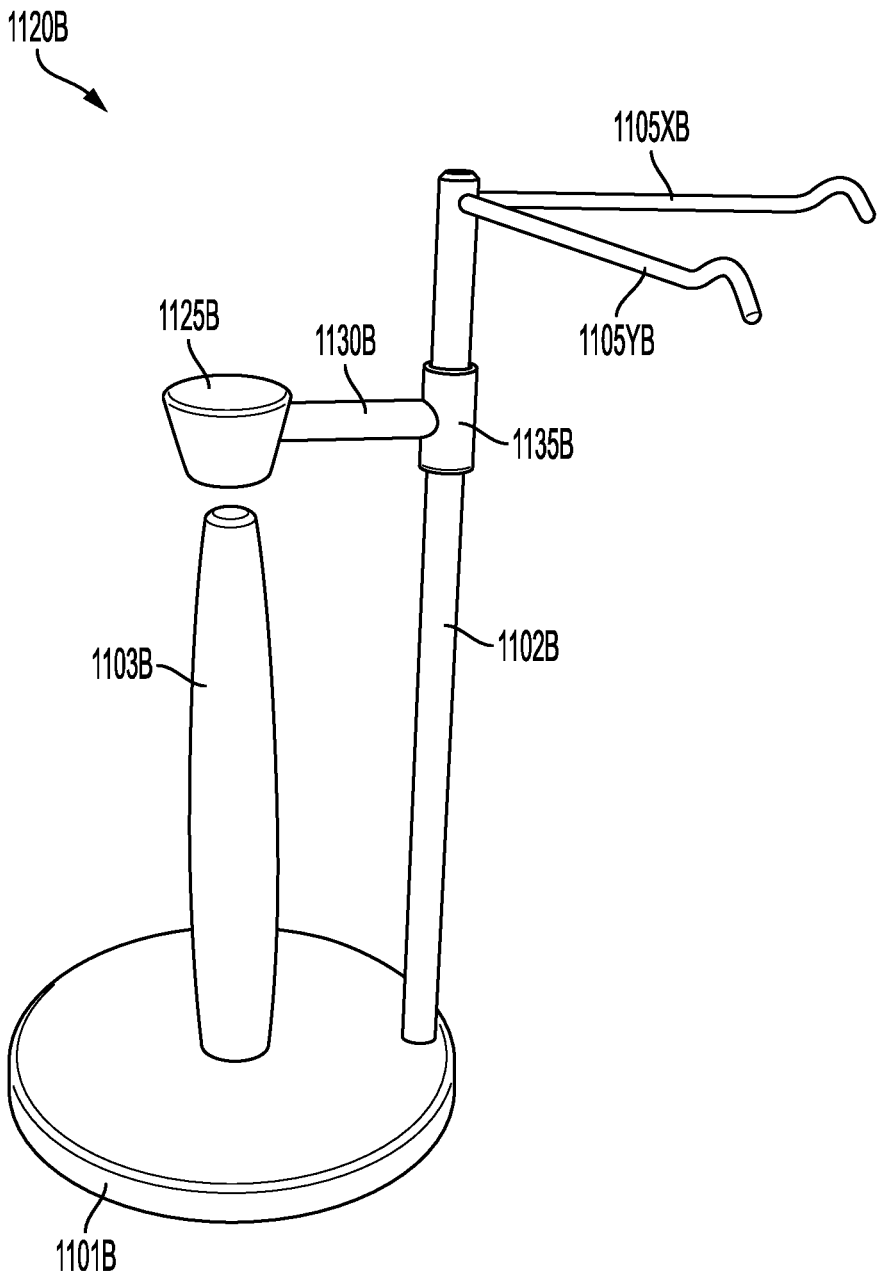

FIG. 11B illustrates an example consolidated towel rack or holder according to various embodiments of the present disclosure. In FIG. 11B, an example consolidated towel rack or holder 1120_B includes a base 1101_B, a first support member 1102_B, a second support member 1103_B, a weighted cap 1125_B, a third support member 1105X_B, and a fourth support member 1105Y_B. The weighted cap 1125_B may be in contact with first support member 1102_B by way of a slide mechanism 1135_B. The weighted cap 1125_B may extend, via an extension member 1130_B, outwardly from first support member 1102_B. In various embodiments, the second support member 1103_B may be configured to receive and support a paper towel roll (not shown in FIG. 11B). In at least the illustrated embodiment, the third support member 1105X_B, in combination with the first support member 1102_B, may be configured to receive and support a (e.g., kitchen, hand, cloth, or fabric-based) towel (not shown in FIG. 11B). In at least the illustrated embodiment, the fourth support member 1105Y_B, in combination with the first support member 1102_B, may be configured to receive and support another towel (not shown in FIG. 11B). It will be appreciated that third support member 1105X_B and fourth support member 1105Y_B may be positioned relative to one another according to a space between them horizontally as well as another space or distance between them vertically along the first support member 1102_B. In various embodiments, one or more of the third support member 1105X_B or the fourth support member 1105Y_B may have a fixed position on the first support member 1102_B or may pivotable around an axis of the first support member 1102_B such that they are rotatable relative to the first support member 1102_B. Embodiments herein may also include an optional tension arm (e.g., depicted in FIG. 12B in 1110), which may be provided to stabilize and/or bias the first support member (e.g., 102A-102H) relative to the second support member (e.g., 103A-103H). A variety of possible tension arm configurations-whether a solid arm, a curved arm, a spring-like member, or otherwise—may be envisioned, without departing from the scope of nature of the present invention.

FIG. 13 illustrates an example consolidated towel rack or holder according to various embodiments of the present disclosure. FIG. 14 illustrates an example consolidated towel rack or holder according to various embodiments of the present disclosure. With reference to FIGS. 13 and 14 in combination, relative to the various embodiments of the third support member (e.g., 1305, 1405) illustrated, it should also be understood that the third support member and/or the first support member (e.g., 1302, 1402) may be selectively removable from the consolidated towel rack or holder (e.g., 1300, 1400), as desirable. A cap (e.g., 1304, 1404), as described previously herein, may be provided in removable embodiments, for coverage of any opening or hole in the first support member (e.g., 1302, 1402) and/or base (e.g., 1301, 1401) or otherwise, upon removal of the third support member.

In addition or alternatively, the third support member (e.g., 1305, 1405) may be adjustable relative to the first support member (e.g., 1302, 1402) and/or the consolidated towel rack or holder (e.g., 1300, 1400) as a whole. As an exemplary example, the third support member (e.g., 1305, 1405) may pivot relative to the first support member (e.g., 1302, 1402), such that the third support member may be raised (or alternatively lowered) into an orientation substantially parallel with the first support member (e.g., 1302, 1402). Additionally or alternatively, the third support member (e.g., 1305, 1405) may be selectively rotatable (and thereafter securable) at different positions around an axis of the first support member (e.g., 1302, 1402). Additionally or alternatively, the third support member (e.g., 1305, 1405) may be selectively translated along a portion of the length of the first support member (e.g., 1302, 1402), for height adjustment of the third support member (e.g., 1305, 1405) and the like.

Although not illustrated, the surface of any one of the support members described herein may be textured, so as to provide some degree of resistance (as compared to a smooth surface) for any items placed in contact with each member. For example, the third and/or fourth support members may have a textured surface to grip a towel or other cleaning apparatus hung thereon. The textured surface may encompass an entirety of one or more of the support members in certain embodiments; in other embodiments, only a portion of the support member may be textured, where a towel or item may typically contact the support member.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A consolidated towel holder, comprising:

a base;

a first support member extending upward from the base;

a second support member extending upward from the base and configured for supporting a paper towel roll; and a third support member extending perpendicularly from the first support member and configured for supporting a fabric towel or cleaning apparatus.

2. The consolidated towel holder of claim 1, further comprising a cap in slidable contact with the first support member via an extension member such that the cap gravitationally rests atop the paper towel roll.

3. The consolidated towel holder of claim 1, further comprising a fourth support member extending perpendicularly from the first support member and configured for supporting one or more additional fabric towels or cleaning apparatuses.

4. The consolidated towel holder of claim 3, wherein one or more of:

the base has a diameter of six inches to 18 inches or 7.5 inches;

the first support member has a length of 14 to 21 inches;

the second support member has a length of 10 to 18 inches;

the second support member has a length of 14.5 inches;

the third support member has a length of 4 to 8 inches;

the third support member has a length of 5.5 to 6 inches;

the fourth support member has a length of 4 to 8 inches; or the fourth support member has a length of 5.5 to 6 inches.

5. The consolidated towel holder of claim 3, wherein the fourth support member is circular.

6. The consolidated towel holder of claim 3, wherein the fourth support member is adjacent the first support member approximately 14.5 inches above the base or 12 to 16 inches above the base.

7. The consolidated towel holder of claim 1, wherein the base is at least partially solid and weighted.

8. The consolidated towel holder of claim 1, wherein a weight of the base is between approximately one pound and four pounds.

9. The consolidated towel holder of claim 1, wherein the base comprises one or more of brass, stainless, aluminum, plastic, or rubber.

10. The consolidated towel holder of claim 1, wherein one or more of the first support member and the second support member is configured to selectively and releasably attach to the base.

11. The consolidated towel holder of claim 1, wherein the second support member is radially centrally positioned on the base.

12. The consolidated towel holder of claim 1, wherein a first length of the first support member is one of greater than or equal to a second length of the second support member.

13. The consolidated towel holder of claim 1, wherein the first support member is spaced axially apart from the second support member by a distance approximately equal to a radius of the paper towel roll.

14. The consolidated towel holder of claim 1, wherein the third support member is adjacent the first support member approximately 14.5 inches above the base or 12 to 16 inches above the base.

15. The consolidated towel holder of claim 1, wherein the third support member is adjacent a distal end of the first support member.

16. The consolidated towel holder of claim 1, wherein one or more of the first support member, the second support member, or the third support member have one or more of equal diameters or differing diameters.

17. The consolidated towel holder of claim 1, wherein one or more of the first support member, the second support member, or the third support member are circular, cylindrical, or tubular.

18. The consolidated towel holder of claim 1, wherein the third support member comprises one or more openings configured for receiving the fabric or cleaning towel.

19. A consolidated towel holder, comprising:

a base;

a pair of first support members extending upward from the base;

a second support member extending upward from the base and configured for supporting a paper towel roll; and a pair of third support members, each third support member of the pair of third support members extending perpendicularly from a respective first support member of the pair of first support members and configured for supporting a fabric towel or cleaning apparatus.

* * * * *